US006311970B1

(12) United States Patent
Miyamoto

(10) Patent No.: US 6,311,970 B1
(45) Date of Patent: Nov. 6, 2001

(54) PAPER FEED CASSETTE AND IMAGE FORMATION APPARATUS

(75) Inventor: Shigeo Miyamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/421,117

(22) Filed: Oct. 19, 1999

(30) Foreign Application Priority Data

Oct. 23, 1998 (JP) ..... 10-301972

(51) Int. Cl.[7] ..... B65H 1/22
(52) U.S. Cl. ..... 271/164; 271/171
(58) Field of Search ..... 271/157, 162, 271/164, 171, 3.14

(56) References Cited

U.S. PATENT DOCUMENTS 4,402,498 * 9/1983 Suzuki ..... 271/164
4,958,823 * 9/1990 Iwaki et al. ..... 271/164
5,085,419 * 2/1992 Bell ..... 271/171
5,537,195 * 7/1996 Sagara et al. ..... 271/171

FOREIGN PATENT DOCUMENTS

0203126 * 8/1989 (JP) ..... 271/164
404246030A * 9/1992 (JP) ..... 271/162
A9110195 4/1997 (JP) .

* cited by examiner

*Primary Examiner*—H. Grant Skaggs

(57) ABSTRACT

In an image formation apparatus in which a paper feed cassette 7 loaded with sheets of recording paper P is mounted and in which the sheets of recording paper are fed to the image formation apparatus in a direction perpendicular to the direction in which the paper feed cassette is mounted, when the paper feed cassette is pulled out in the event of a paper jam, the rear plate 7*a* of the paper feed cassette 7 is engaged with a first engagement portion 1*a* provided on the body 1 of the image formation apparatus, and is thereby inclined against the force exerted by a pulling spring 15 so as to avoid interference with the sheet of paper P" that is causing the jam.

5 Claims, 18 Drawing Sheets

PAPER FEED CASSETTE AND IMAGE FORMATION APPARATUS

BACKGROUND OF THE INVENTION

1. Field of the Invention

The present invention relates to an image formation apparatus, such as a facsimile machine, printer, or photocopier, having a paper feed cassette, and to a paper feed cassette for use with such an image formation apparatus.

2. Description of the Prior Art

FIGS. 17A and 17B show a top view and a front view, respectively, of a conventional facsimile machine. The facsimile machine has a body 1, and in a central side portion of the body 1 is provided a power supply section 13. In an upper portion of the body 1 are provided an operation section 3 for performing transmission and other operations and an original document placement section 2 for placing a document to be transmitted. The information written or drawn on the original document is read by a reader section 5. Then, the information thus read is transmitted, and the original document is fed out in the direction indicated by the arrow A so as to be stocked in an original document stacker 4.

In a lower portion of the body 1 is provided a paper feeder section 6. Sheets of recording paper P are lifted upward by a lifting plate 8 so as to be pressed against a pickup roller 9. When a facsimile document is received, the pickup roller 9 rotates and thereby feeds forward one sheet after another of recording paper. These sheets of recording paper are then, one by one, fed between transfer rollers 10 to a recording section 11. In the recording section 11, images are formed on the sheets of recording paper in accordance with the received information. The sheets of recording paper P' having images formed thereon are then fed out in the direction indicated by the arrow B so as to be stocked in a recording paper stacker 12.

FIGS. 18A and 18B show a sectional view as seen from above and a sectional view as seen from the front, respectively, of the paper feeder section 6. As shown in these figures, the sheets of recording paper P are loaded in a paper feed cassette 7. As shown in FIG. 19, replenishment of the sheets of recording paper P is performed with the paper feed cassette 7 pulled out in the direction indicated by the arrow C.

A facsimile machine having a construction as described above requires a space to pull out the paper feed cassette 7 on one side (in the above example, on the right side) of the body 1, and thus the body 1 occupies an accordingly large area. For this reason, as shown in FIGS. 20A and 20B, some commercially available facsimile machines are so designed that the paper feed cassette 7 is pulled out on the front side (in the direction indicated by the arrow D), where a space is secured to allow operation by the user. This helps reduce the area occupied by the body 1.

However, in a facsimile machine having a construction as described just above, the direction in which the paper feed cassette 7 is pulled out is perpendicular to the direction in which the sheets of recording paper are fed to the recording section 11 (see FIG. 17B). As a result, as shown in FIGS. 21A and 21B, which are a sectional view as seen from above and a sectional view as seen from the side, respectively, when a paper jam occurs, the sheet of recording paper P"that is causing the jam may interfere with the rear plate 7*a* of the paper feed cassette 7 and thereby hinder the paper feed cassette 7 from being pulled out. This complicates removal of the sheet of recording paper P" that is causing the jam and thus recovery from the jam.

Moreover, the size of the sheets of recording paper P actually used varies from user to user. For this reason, the paper feed cassette 7 needs to be made so wide as to cope with the longest sheets of recording paper P generally available, and thus also the body 1 of the facsimile machine needs to be made accordingly wide.

For example, as shown in FIG. 20B mentioned previously, even if a user uses only letter-size sheets (having a length L1=279 mm) and A4-size sheets (having a length L2=297 mm), he has no choice but to use a paper feed cassette 7 that is made so wide W1 as to cope with legal-size sheets (having a length L3=356 mm). As a result, also the body 1 of the facsimile machine needs to be made accordingly wide W2, and thus occupies an unnecessarily large area.

SUMMARY OF THE INVENTION

An object of the present invention is to provide a paper feed cassette that ensures easy removal of a sheet of recording paper in the event of a paper jam.

Another object of the present invention is to provide an image formation apparatus that ensures easy dismounting of a paper feed cassette in the event of a paper jam.

Still another object of the present invention is to provide an image formation apparatus that allows use of various types of sheets of recording paper having different lengths and that nevertheless occupies a minimum of area.

To achieve the above objects, according to one aspect of the present invention, in a paper feed cassette, loaded with sheets of recording paper and mounted in an image formation apparatus, for feeding the sheets of recording paper to the image formation apparatus, at least a part of the rear wall of the paper feed cassette, as seen from the direction from which the paper feed cassette is mounted, is brought into an inclined state when the paper feed cassette is dismounted.

According to another aspect of the present invention, in a paper feed cassette, loaded with sheets of recording paper and mounted in an image formation apparatus, for feeding the sheets of recording paper to the image formation apparatus, at least a part of the rear wall of the paper feed cassette, as seen from the direction from which the paper feed cassette is mounted, is cut out.

According to another aspect of the present invention, in an image formation apparatus in which a paper feed cassette loaded with sheets of recording paper is mounted and in which the sheets of recording paper are fed to the image formation apparatus in a direction perpendicular to the direction in which the paper feed cassette is mounted, at least a part of the rear wall of the paper feed cassette, as seen from the direction from which the paper feed cassette is mounted, is brought into an inclined state when the paper feed cassette is dismounted.

According to another aspect of the present invention, in an image formation apparatus in which a paper feed cassette loaded with sheets of recording paper is mounted and in which the sheets of recording paper are fed to the image formation apparatus in a direction perpendicular to the direction in which the paper feed cassette is mounted, at least a part of the rear wall of the paper feed cassette, as seen from the direction from which the paper feed cassette is mounted, is cut out.

According to still another aspect of the present invention, in an image formation apparatus in which a paper feed cassette loaded with sheets of recording paper is mounted and in which the sheets of recording paper are fed to the image formation apparatus in a direction perpendicular to the direction in which the paper feed cassette is mounted, the image formation apparatus has an insertion cavity that is open, at one side, toward the insertion surface through which the paper feed cassette is inserted into the image formation apparatus and, at another side, toward a side surface that is perpendicular to the insertion surface. Here, the insertion cavity makes the insertion surface and the side surface each appear to be C-shaped.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1A:
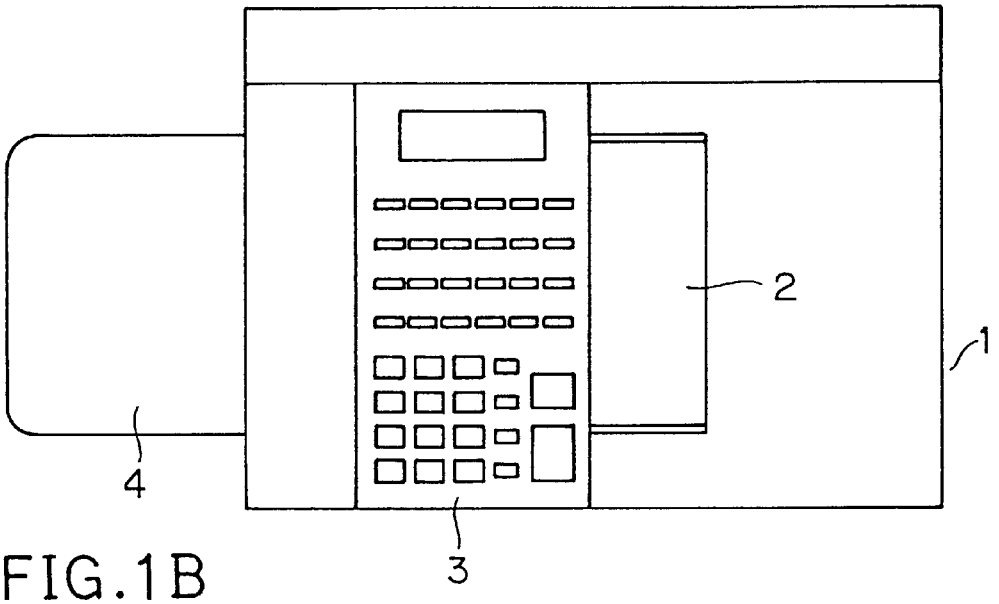
FIGS. 1A and 1B are diagrams showing the facsimile machine of a first embodiment of the present invention.
Figure 1B:
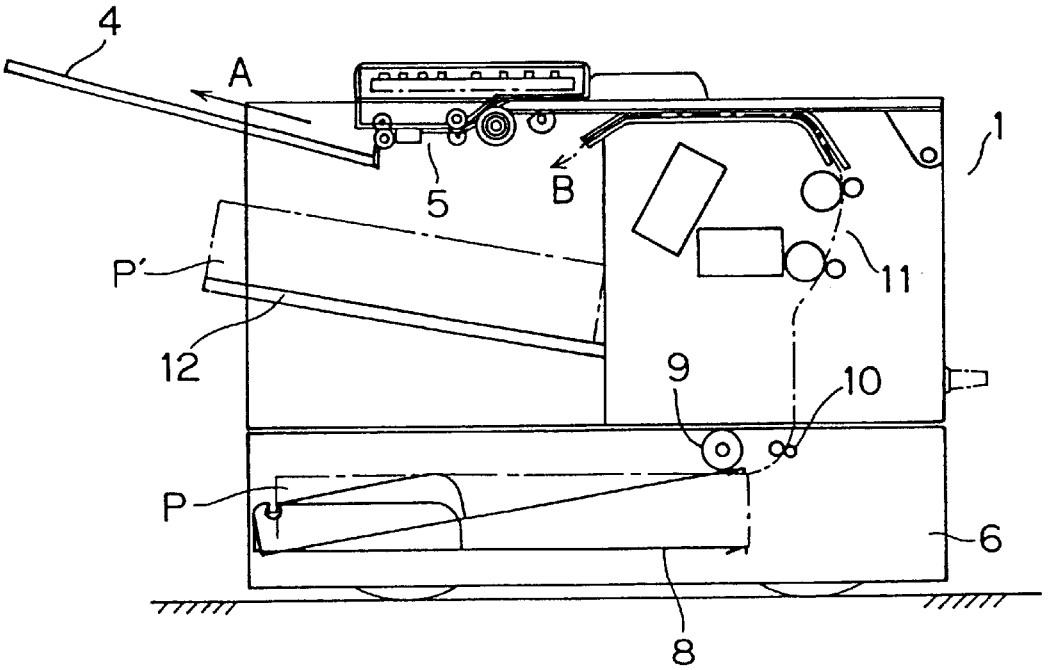

Hereinafter, embodiments of the present invention will be described with reference to the accompanying drawings. For convenience's sake, such components as are found also in FIGS. 17A, 17B, 18A, 18B, 19, 20A, 20B, 21A, and 21B will be identified with the same reference numerals and symbols. FIGS. 1A and 1B are a top view and a front view, respectively, of the facsimile machine of a first embodiment of the present invention. The facsimile machine has a body 1, and in an upper portion of the body 1 are provided an operation section 3 for performing transmission and other operations and an original document placement section 2 for placing a document to be transmitted. The information written or drawn on the original document is read by a reader section 5. Then, the information thus read is transmitted, and the original document is fed out in the direction indicated by the arrow A so as to be stocked in an original document stacker 4.

In a lower portion of the body 1 is provided a paper feeder section 6. Sheets of recording paper P are lifted upward by a lifting plate 8 so as to be pressed against a pickup roller 9. When a facsimile document is received, the pickup roller 9 rotates and thereby feeds forward one sheet after another of recording paper. These sheets of recording paper are then, one by one, fed between transfer rollers 10 to a recording section 11. In the recording section 11, images are formed on the sheets of recording paper in accordance with the received information. The sheets of recording paper P' having images formed thereon are then fed out in the direction indicated by the arrow B so as to be stocked in a recording paper stacker 12.

Figure 2B:
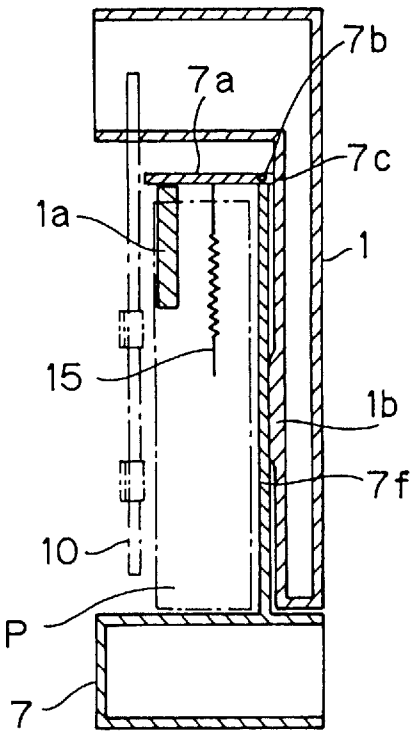
FIGS. 2A and 2B are diagrams showing the paper feeder section of the facsimile machine of the first embodiment.
Figure 2A:
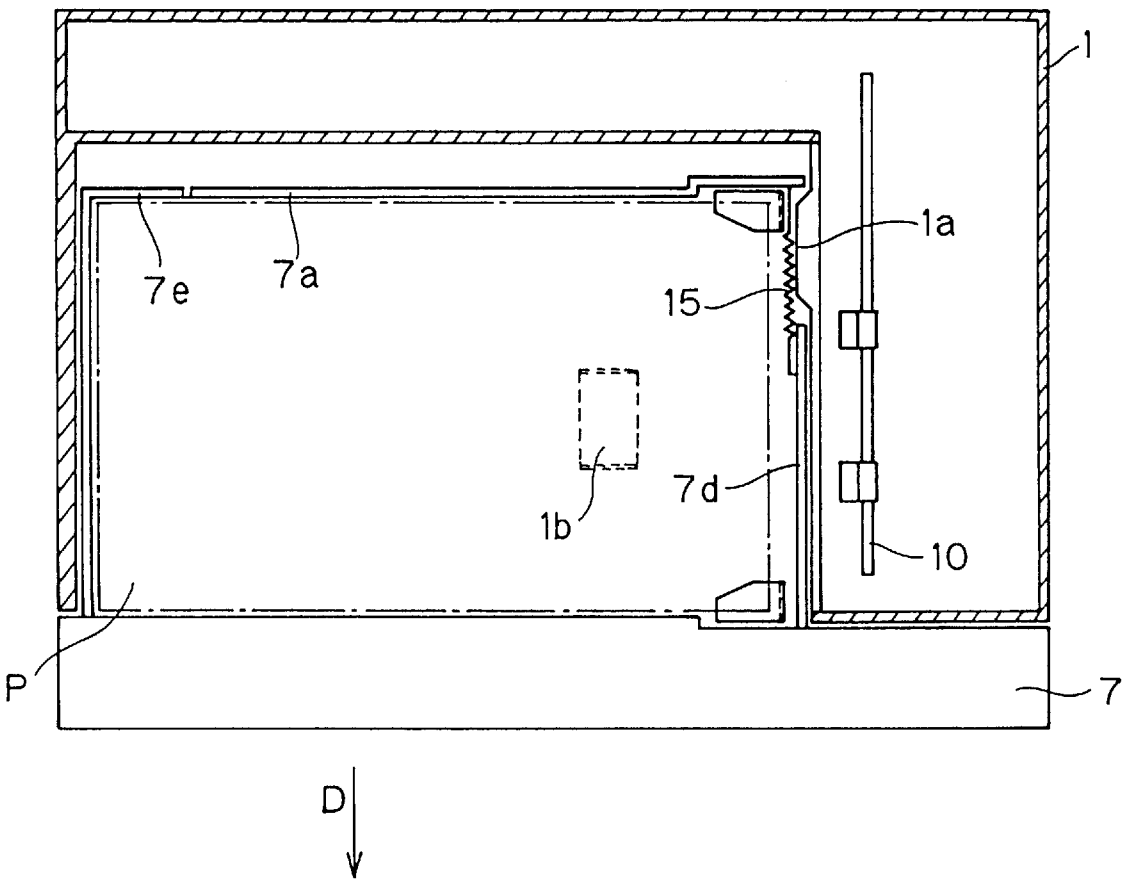
Figure 3:
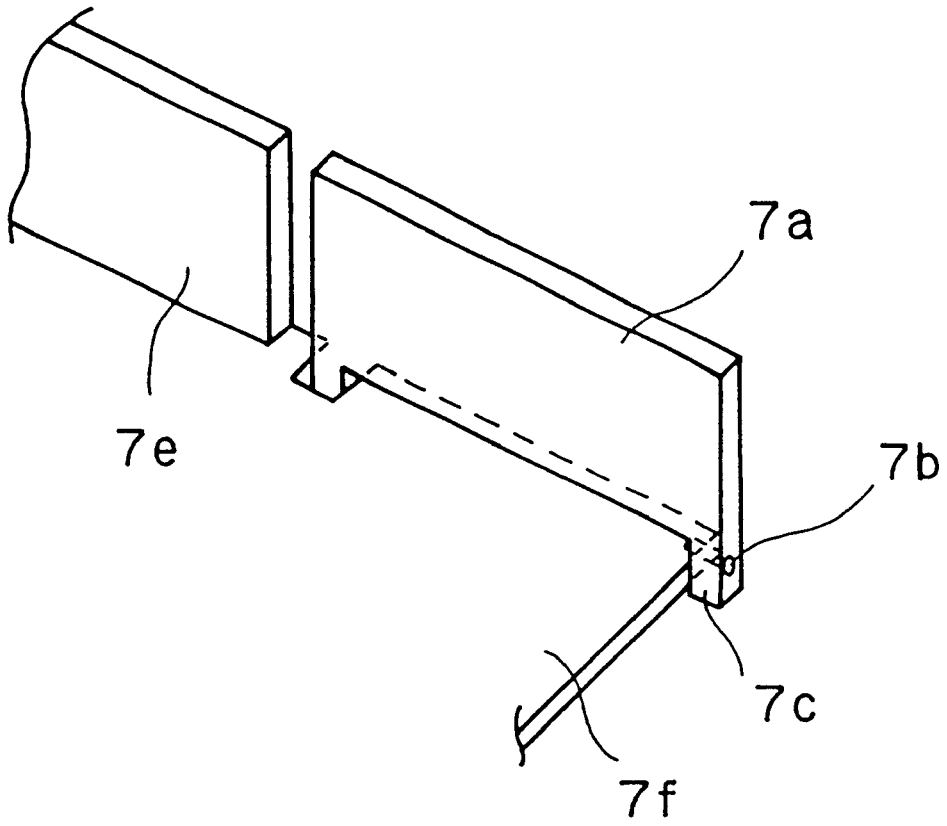
FIG. 3 is a perspective view of a part of the paper feed cassette of the facsimile machine of the first embodiment.

FIGS. 2A and 2B show a sectional view as seen from above and a sectional view as seen from the side, respectively, of the paper feeder section 6. The sheets of recording paper P are loaded in a paper feed cassette 7. Replenishment of the sheets of recording paper P is performed with the paper feed cassette 7 pulled out in the direction indicated by the arrow D. The paper feed cassette 7 has a rear plate 7*a*, which is loaded with a force that tends to pull it toward a side plate 7*d* of the paper feed cassette 7 by a pulling spring 15. Moreover, as shown in FIG. 3, the rear plate 7*a* is supported by a bottom plate 7*f* of the paper feed cassette 7 so as to be rotatable about a shaft 7*b*. Accordingly, the rear plate 7*a*, when it receives a force that acts in the direction opposite to the arrow D against the force exerted by the pulling spring 15, rotates about the shaft 7*b*.

Moreover, the rear plate 7*a* has a protrusion 7*c* provided thereon so as to protrude downward from the bottom plate 7*f*. Furthermore, the rear plate 7*a* has a stopper (not shown) provided thereon, which prevents the rear plate 7*a* from being inclined toward the inside (where the sheets of recording paper P are loaded) of the paper feed cassette 7 by the force exerted by the pulling spring 15.

Figure 4B:
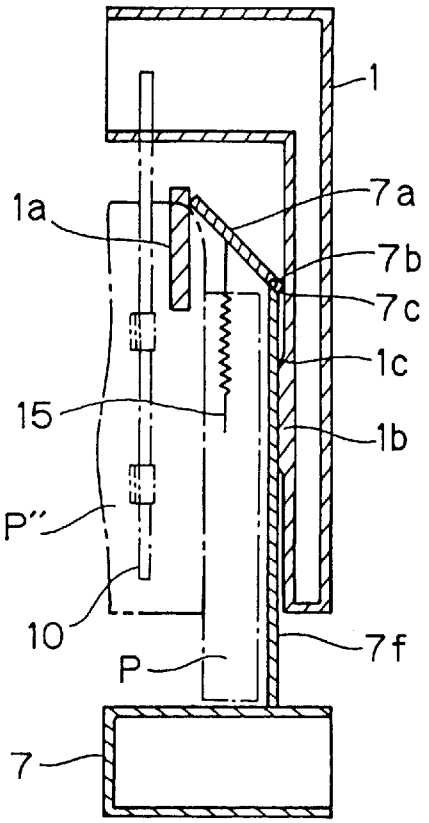
FIGS. 4A and 4B are diagrams showing how the paper feed cassette is pulled out in the facsimile machine of the first embodiment.
Figure 4A:
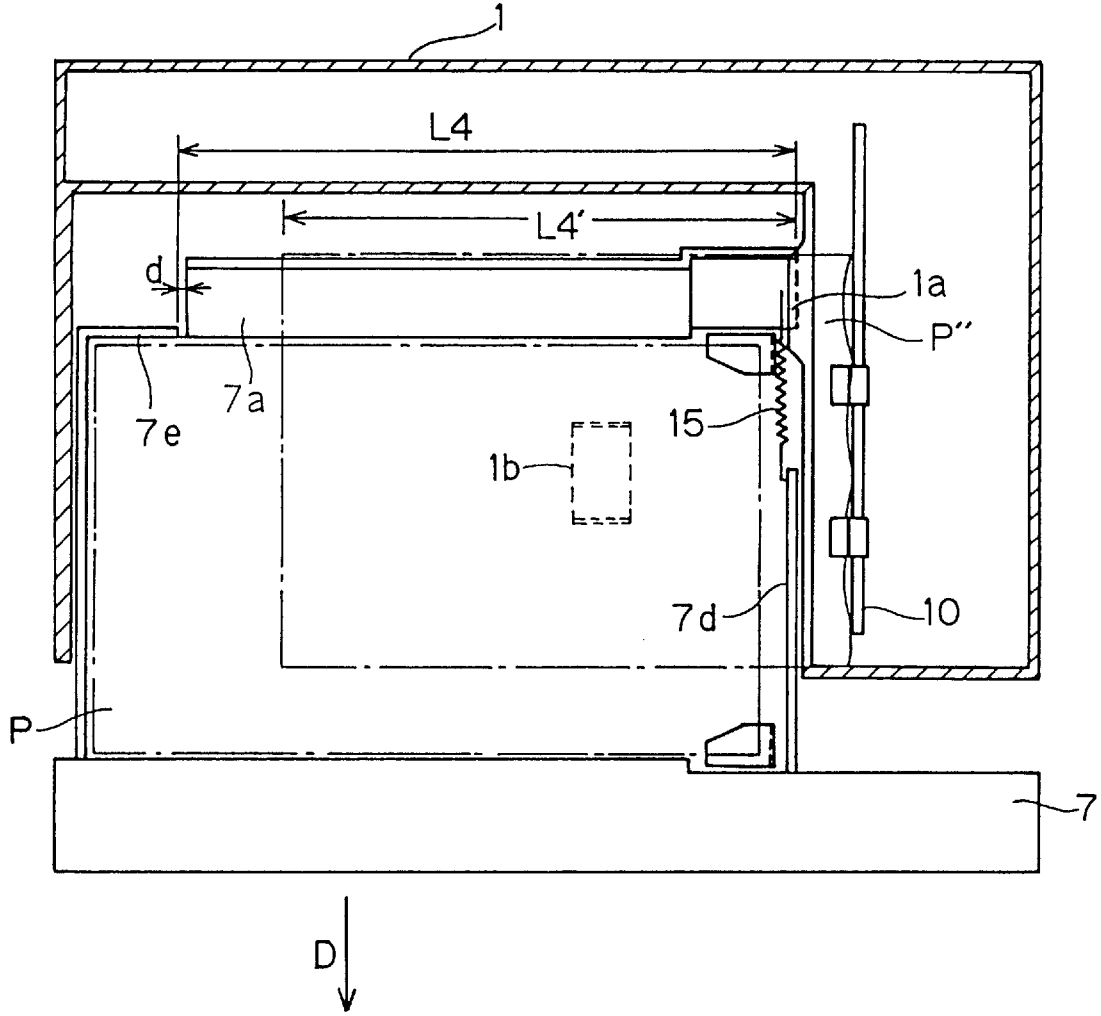

On the other hand, on the body 1 of the facsimile machine, a first engagement portion 1*a* that engages with an upper portion of the rear plate 7*a* and a second engagement portion 1*b* that engages with the protrusion 7*c* are provided both so as to protrude from the portion surrounding them. When the paper feed cassette 7 is pulled out in the direction indicated by the arrow D, the rear plate 7*a* engages with the first engagement portion 1*a* as shown in FIGS. 4A and 4B. In the event of a paper jam, this allows the rear plate 7*a* to be inclined, making it possible o avoid interference with the sheet of recording paper P" that is causing the jam.

Moreover, as the paper feed cassette 7 is pulled out, the protrusion 7*c* reaches the second engagement portion 1*b* and engages with an inclined portion 1*c* thereof. As the paper feed cassette 7 is pulled out further, the protrusion 7*c* runs onto a top portion of the second engagement portion 1*b*, causing the rear plate 7*a* to be inclined further. This makes it possible to dismount the paper feed cassette 7 easily without interference with the sheet of recording paper P" that is causing the jam. Thus, it is possible to recover from a paper jam easily.

Figure 5B:
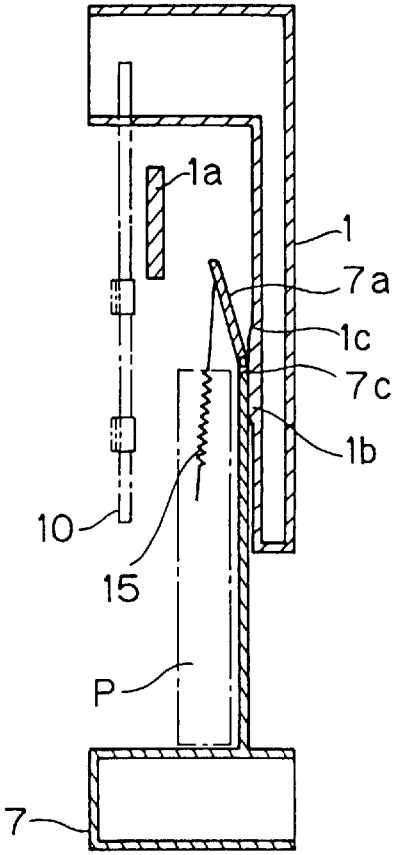
FIGS. 5A and 5B are diagrams showing how the paper feed cassette is inserted in the facsimile machine of the first embodiment.
Figure 5A:
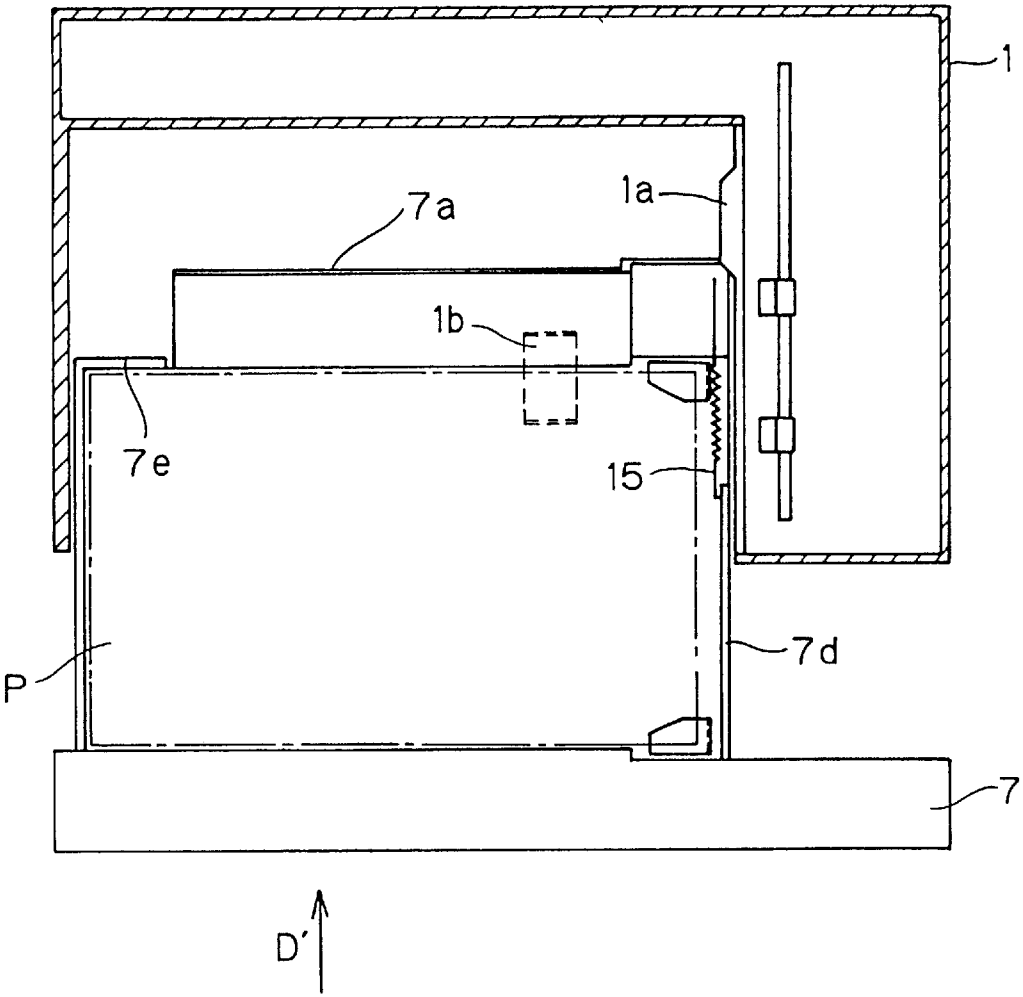

When the paper feed cassette 7 is mounted in the body 1 of the facsimile machine, the paper feed cassette 7 is inserted in the direction indicated by the arrow D' as shown in FIGS. 5A and 5B. When the protrusion 7*c* engages with the second engagement portion 1*b*, the rear plate 7*a* is inclined. This makes it possible to mount the paper feed cassette 7 without interference of its rear plate 7*a* with the first engagement portion 1*a*. When the mounting of the paper feed cassette 7 is complete, the protrusion 7*c* disengages from the second engagement portion 1*b*. Then, the pulling spring 15 causes the rear plate 7*a* to move back to the position where it keeps the sheets of recording paper P in position.

In FIG. 4A, the length L4 of the portion that does not make contact with the sheets of recording paper P when the rear plate 7*a* is inclined (this length L4 includes the length of the rear plate 7*a* itself and a gap d) is so determined as to be equal to the maximum imaginable length L4' of the portion of a sheet of recording paper P" that is left behind in the paper feed cassette 7 in the event of a paper jam, and a wall 7*e*, non-inclinable, is provided along that part of the rear portion of the paper feed cassette 7 which lies beyond the length L4. This helps secure sufficiently high mechanical strength in the paper feed cassette 7.

Figure 6B:
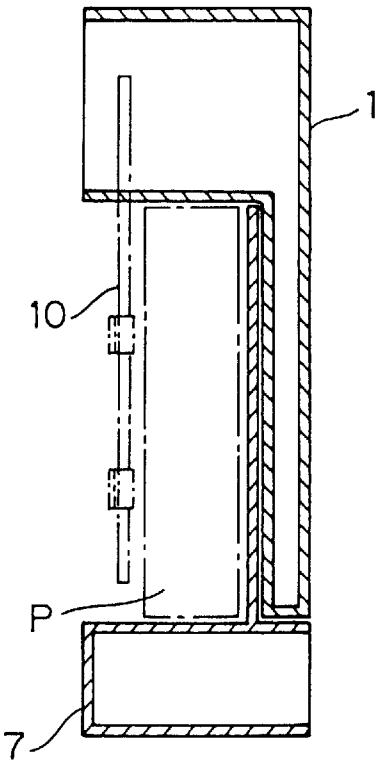
FIGS. 6A and 6B are diagrams showing the paper feeder section of the facsimile machine of a second embodiment of the present invention.
Figure 6A:
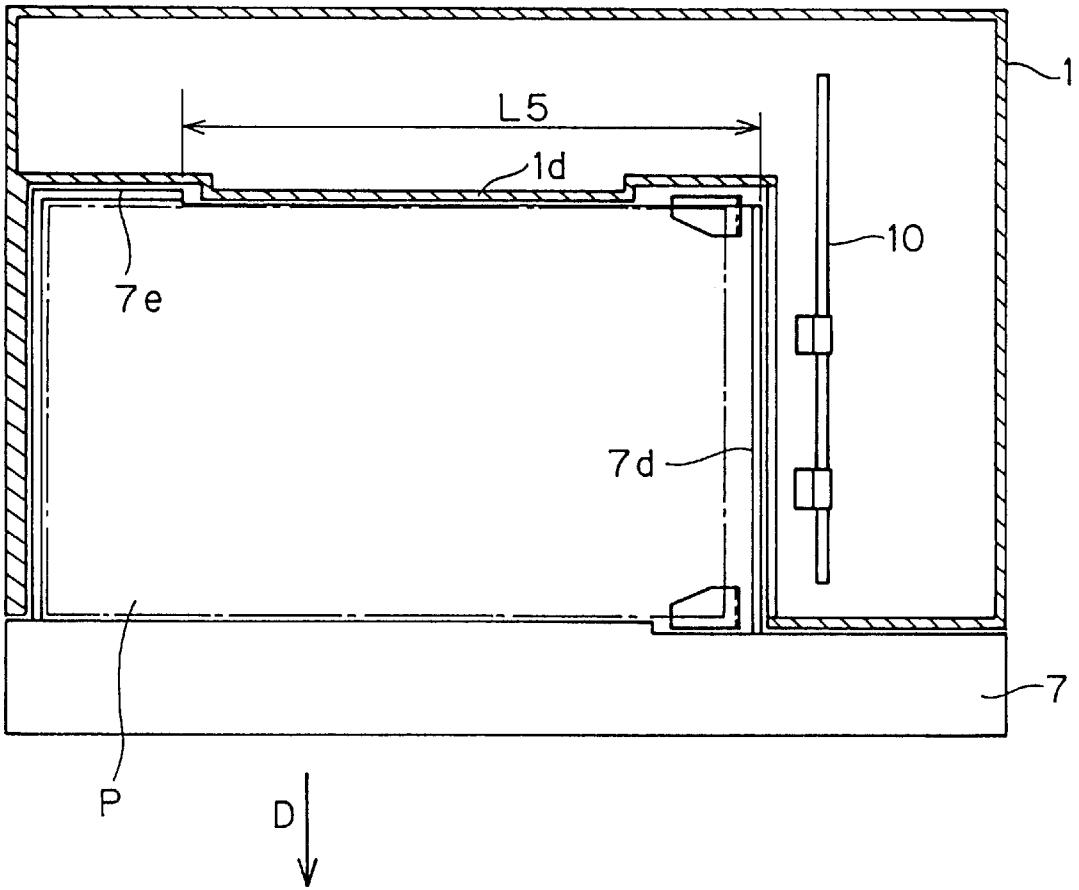

FIGS. 6A and 6B are a sectional view as seen from above and a sectional view as seen from the side, respectively, of the paper feeder section 6 of the facsimile machine of a second embodiment of the present invention. The sheets of recording paper P are loaded in a paper feed cassette 7. Replenishment of the sheets of recording paper P is performed with the paper feed cassette 7 pulled out in the direction indicated by the arrow D. The paper feed cassette 7 has a predetermined part (L5) of the rear portion thereof cut out. To prevent the sheets of recording paper P from being brought into a state of disorder due to the lack of the part of the rear portion of the paper feed cassette 7, a paper holding portion 1*d* is provided on the body 1 of the facsimile machine so as to protrude therefrom.

Figure 7B:
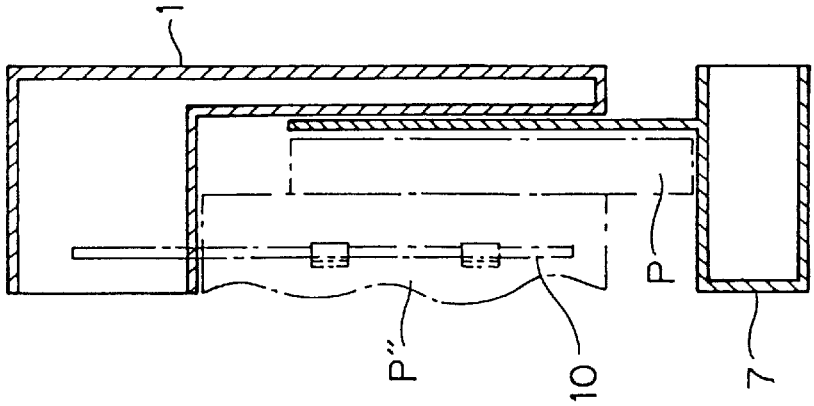
FIGS. 7A and 7B are diagrams showing how the paper feed cassette is pulled out in the facsimile machine of the second embodiment.
Figure 7A:
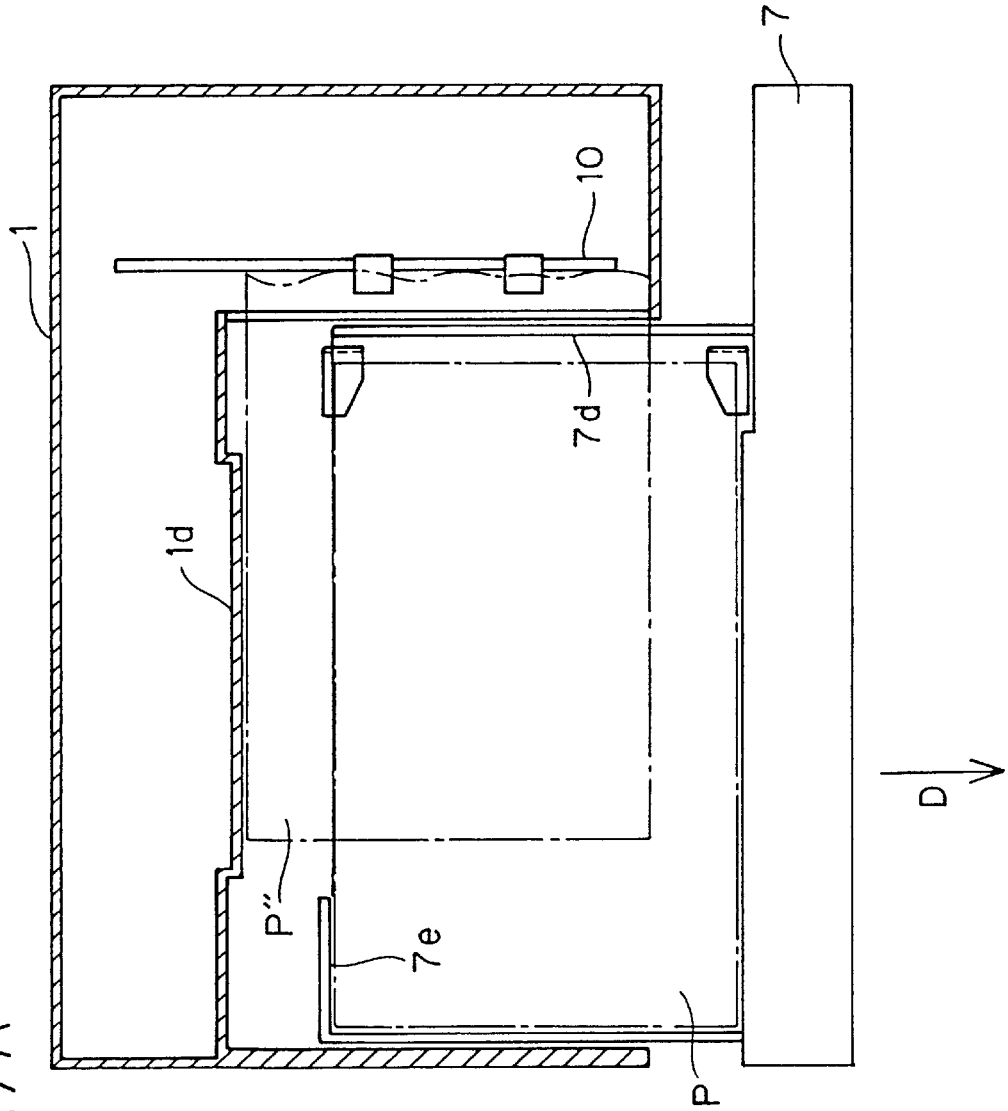

Accordingly, as shown in FIGS. 7A and 7B, in the event of a paper jam. it is possible to pull out the paper feed cassette 7 in the direction indicated by the arrow D easily without interference with the sheet of recording paper P" that is causing the jam. Thus, it is possible to recover from a paper jam easily.

In FIG. 6A, the length L5 of that part of the rear portion of the paper feed cassette 7 which does not make contact with the sheets of recording paper P is so determined as to be equal to the maximum imaginable length L4' (see FIG. 4A) of the portion of a sheet of recording paper P" that is left behind in the paper feed cassette 7 in the event of a paper jam, and a wall 7*e*, fixed, is provided along that part of the rear portion of the paper feed cassette 7 which lies beyond the length L5. This helps secure sufficiently high mechanical strength in the paper feed cassette 7.

Figure 8:
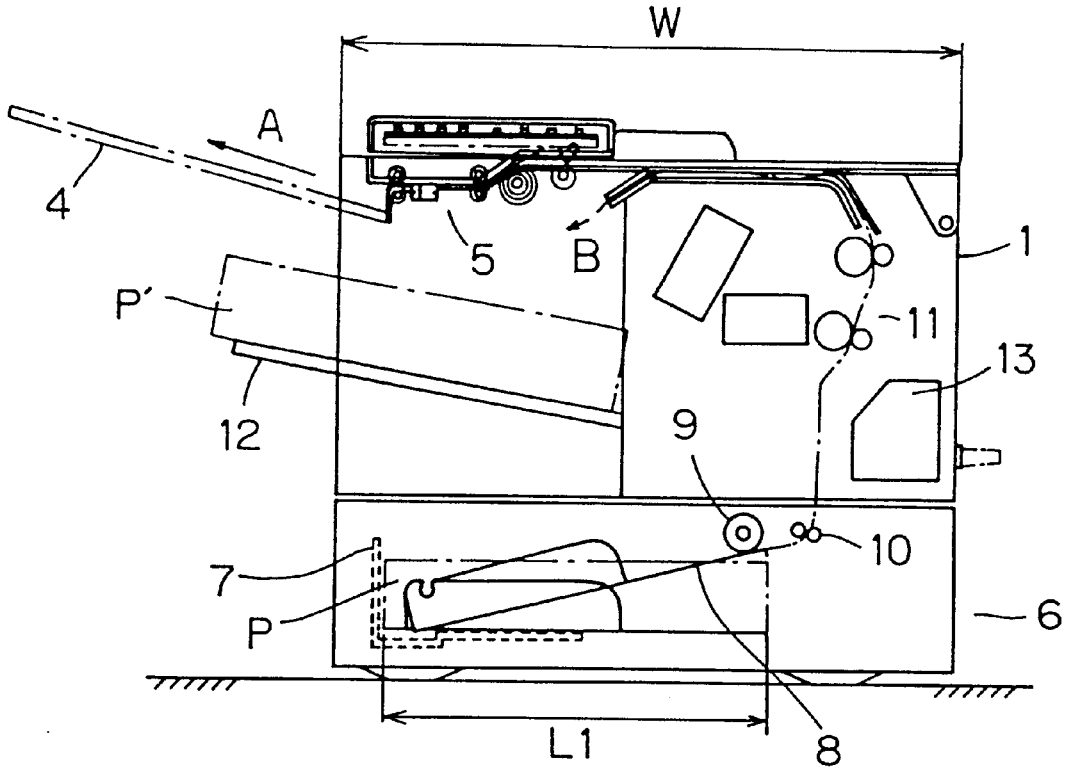
FIG. 8 is a diagram showing the facsimile machine of a third embodiment of the present invention, in its state when letter-size sheets are used.
Figure 9A:
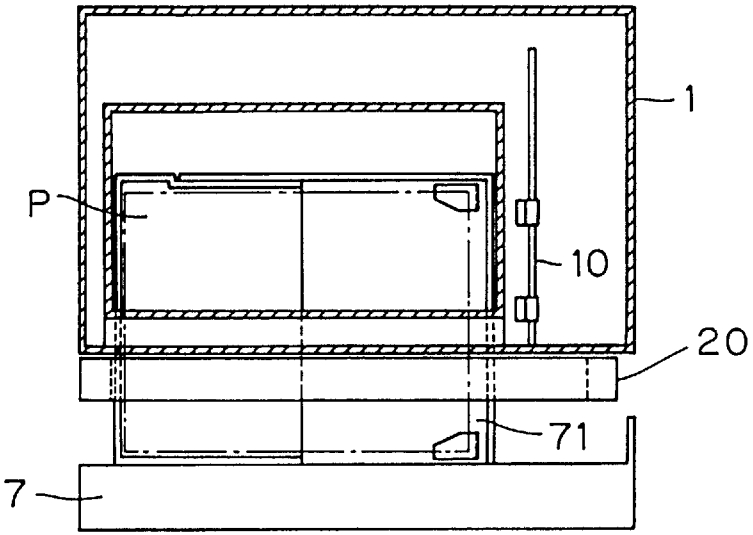
FIGS. 9A, 9B, and 9C are diagrams showing the paper feeder section of the facsimile machine of the third embodiment, in its state when letter-size sheets are used.
Figure 9B:
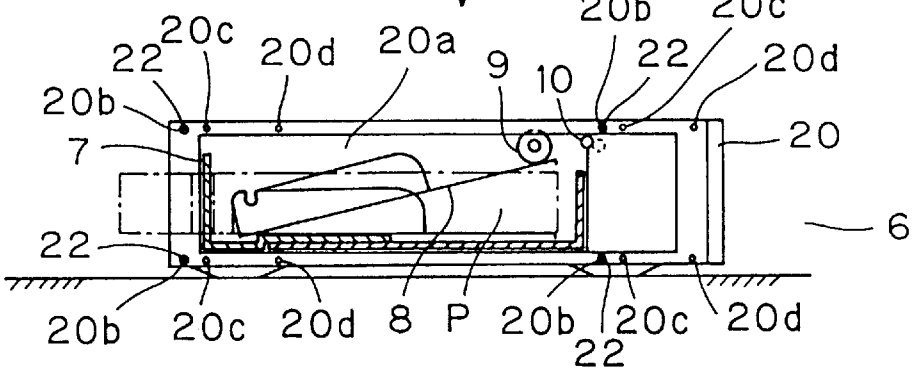
Figure 9C:
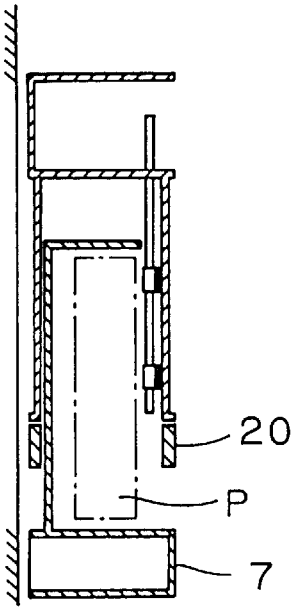

FIG. 8 is a front view of the facsimile machine of a third embodiment of the present invention. This figure shows a case where only letter-size sheets (having a length L1=279 mm) are used as the sheets of recording paper P. FIGS. 9A, 9B, and 9C are a sectional view as seen from above, a sectional view as seen from the front, and a sectional view as seen from the side, respectively, of the paper feeder section 6, in its state when the paper feed cassette 7 is pulled forward. On the front surface of the body 1 of the facsimile machine is fitted a frame 20 having an opening 20*a*. The paper feed cassette 7, in which sheets of recording paper P are loaded, is mounted in the body 1 of the facsimile machine through this opening 20*a*. Replenishment of the sheets of recording paper P is performed with the paper feed cassette 7 pulled out in the direction indicated by the arrow D.

Figure 10A:
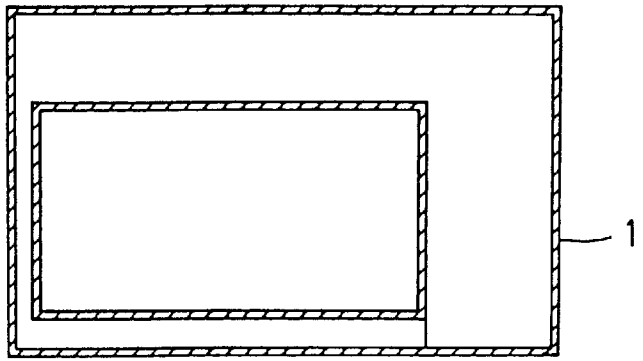
FIGS. 10A, 10B, and 10C are diagrams showing the paper feeder section of the facsimile machine of the third embodiment.
Figure 10B:
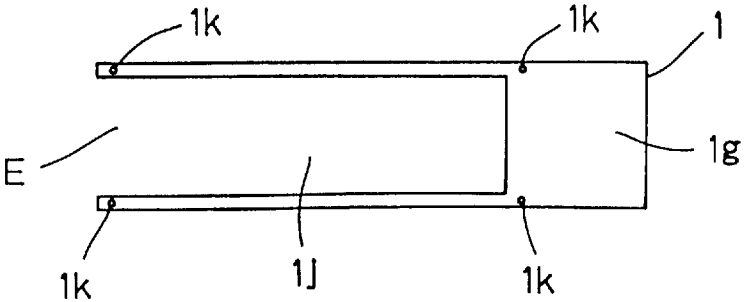
Figure 10C:
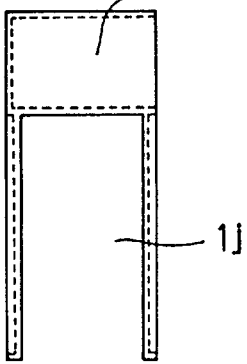
Figure 11A:
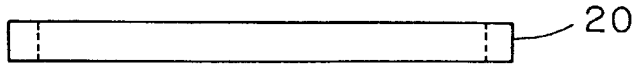
FIGS. 11A and 11B are diagrams showing the frame of the facsimile machine of the third embodiment.
Figure 11B:
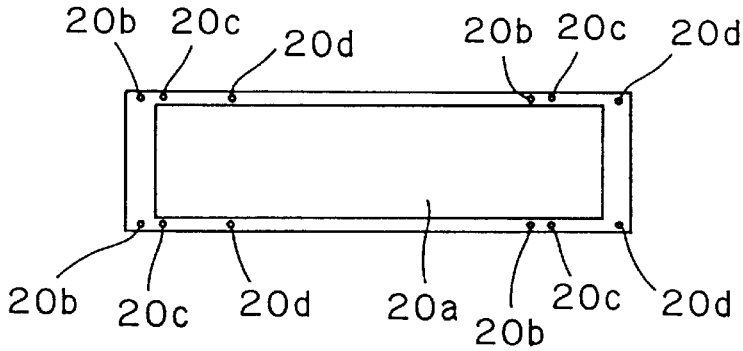

FIGS. 10A, 10B, and 10C are a sectional view as seen from above, a front view, and a side view, respectively, of the appearance of the portion of the body 1 of the facsimile machine that constitutes the paper feeder section 6. As shown in these figures, in the body 1 of the facsimile machine, a cavity 1*j* is provided that is open, at one side, toward the front surface 1*g* through which the paper feed cassette 7 is inserted into the body 1 and, at another side, toward the side surface 1*h* opposite to the direction in which the sheets of recording paper P are fed. Accordingly, when seen from the front or from the side, the paper feeder section 6 of the body 1 of the facsimile machine appears to be C-shaped. Moreover, in the front surface 1*g*, four threaded holes 1*k* are provided. FIGS. 11A and 11B are a top view and a front view, respectively, showing the frame 20 in detail. In the frame 20, around the opening 20*a*, three sets of four holes 20*b*, 20*c*, and 20*d* are provided, with each set of four holes arranged at such intervals as to correspond to the above-mentioned threaded holes 1*k*.

By screw-engaging bolts with the threaded holes 1*k* of the body 1 of the facsimile machine through one of the three sets of four holes 20*b*, 20*c*, and 20*d*, the frame 20 can be fixed in different positions on the body 1 of the facsimile machine. FIGS. 8, 9A, 9B, and 9C mentioned previously show the state in which the frame 20 is fixed on the body 1 of the facsimile machine by screw-engaging bolts 22 through the set of holes 20*b*.

Figure 12:
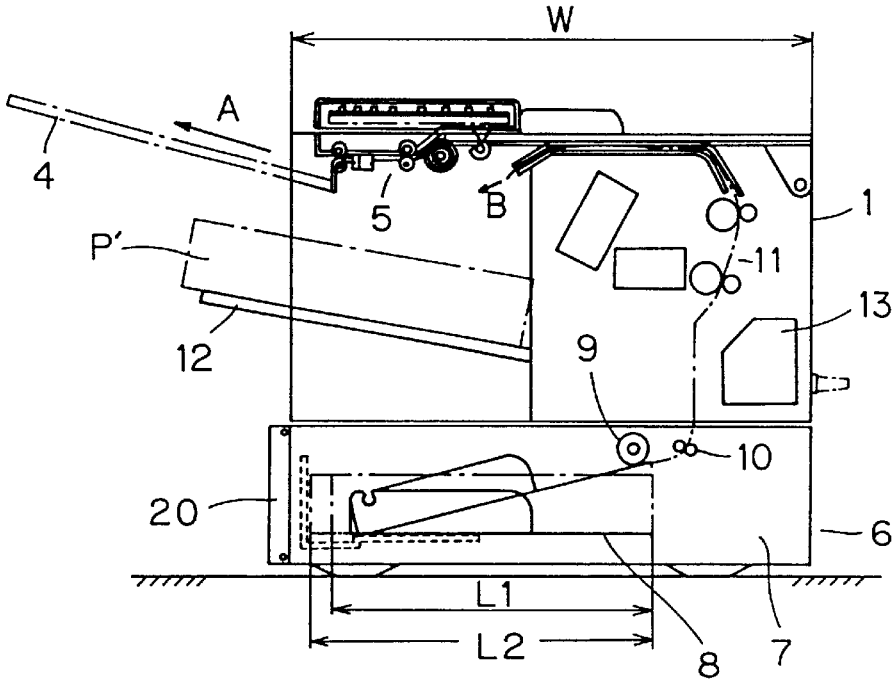
FIG. 12 is a diagram showing the facsimile machine of the third embodiment, in its state when A4-size sheets are used.
Figure 13A:
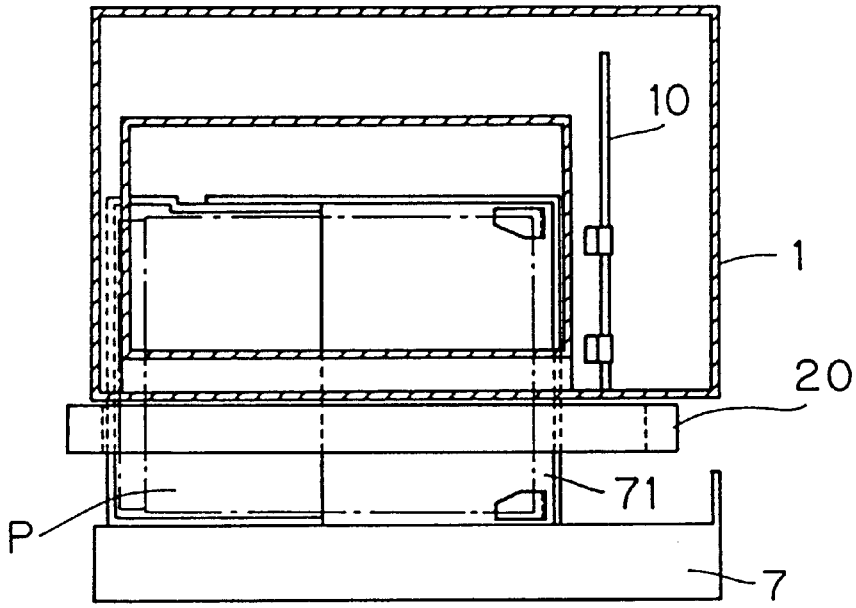
FIGS. 13A and 13B are diagrams showing the paper feeder section of the facsimile machine of the third embodiment, in its state when A4-size sheets are used.
Figure 13B:
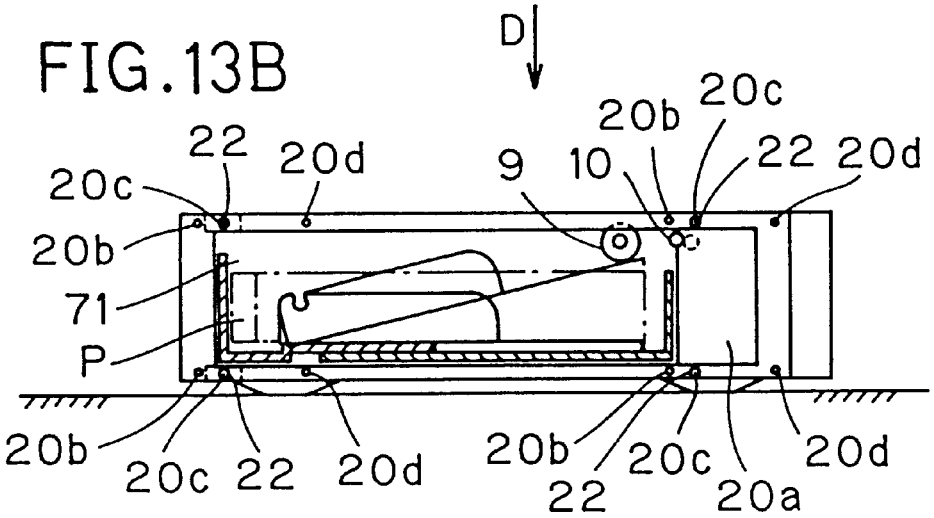

FIGS. 12, 13A, and 13B show the state in which the frame 20 is fixed on the body 1 of the facsimile machine by screw-engaging bolts 22 through the set of holes 20*c* of the frame 20. FIG. 12 is a front view of the facsimile machine; FIGS. 13A and 13B are a sectional view as seen from above and a sectional view as seen from the front, respectively, of the paper feeder section 6, in its state when the paper feed cassette 7 is pulled out. In these figures, the frame 20 is fixed further left as compared with its position shown in FIG. 8. This allows use of a larger tray 71 in the paper feed cassette 7.

In this case, even through the tray 71 is larger, the paper feeder section 6 of the body 1 of the facsimile machine remains C-shaped (see FIGS. 10B and 10C), and thus the paper feed cassette 7 can be mounted in the body 1 without interference therewith. Accordingly, it is possible to use letter-size sheets (having a length L1=279 mm) and A4-size sheets (having a length L2=297 mm) as the sheets of recording paper P.

Figure 14:
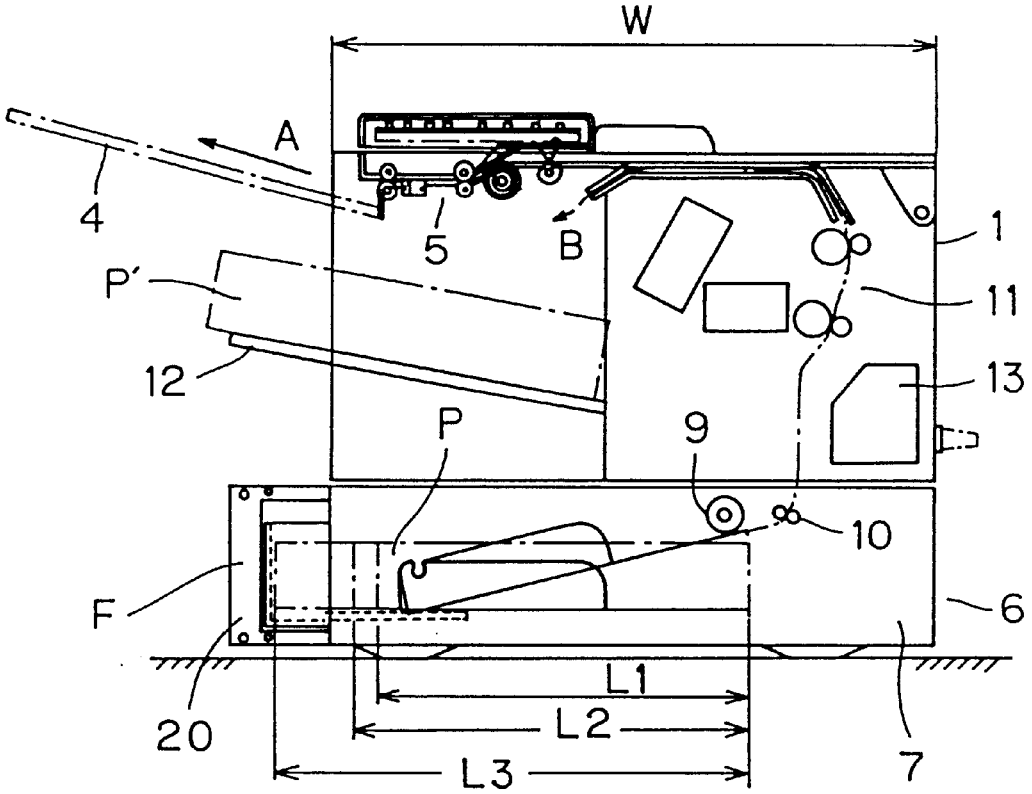
FIG. 14 is a diagram showing the facsimile machine of the third embodiment, in its state when legal-size sheets are used.
Figure 15A:
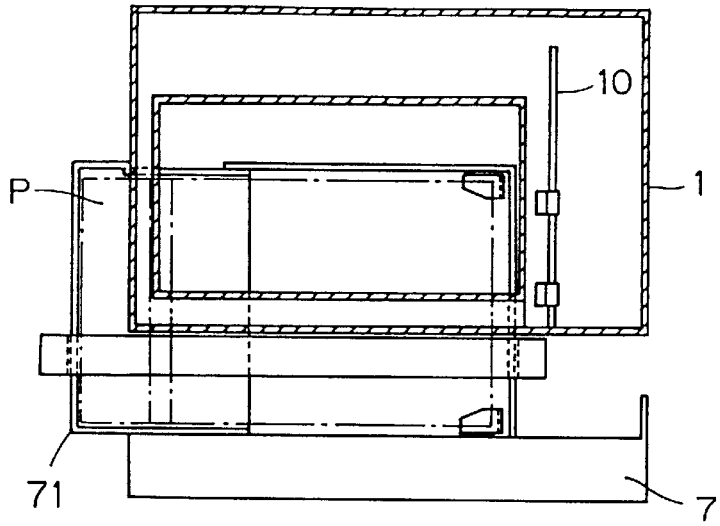
FIGS. 15A and 15B are diagrams showing the paper feeder section of the facsimile machine of the third embodiment, in its state when legal-size sheets are used.
Figure 15B:
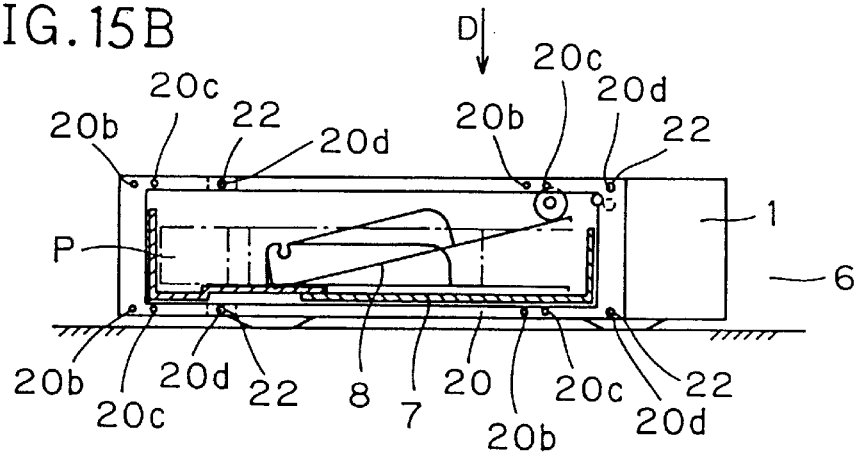

FIGS. 14, 15A, and 15*b* show the state in which the frame 20 is fixed on the body 1 of the facsimile machine by screw-engaging bolts 22 through the set of holes 20*d* of the frame 20. FIG. 14 is a front view of the facsimile machine; FIGS. 15A and 15B are a sectional view as seen from above and a sectional view as seen from the front, respectively, of the paper feeder section 6, in its state when the paper feed cassette 7 is pulled out. In these figures, the frame 20 is fixed further left as compared with its position shown in FIG. 12. This allows use of a still larger tray 71 in the paper feed cassette 7.

In this case, even through the tray 71 is larger, the paper feeder section 6 of the body 1 of the facsimile machine remains C-shaped (see FIGS. 10B and 10C), and thus the paper feed cassette 7 can be mounted in the body 1 without interference therewith in such a way as to protrude from the body 1 in the direction opposite to the direction in which the sheets of recording paper P are fed. Accordingly, it is possible to use letter-size sheets (having a length L1 279 mm), A*4*-size sheets (having a length L2=297 mm), and legal-size sheets (having a length L3=356 mm) as the sheets of recording paper P.

In the facsimile machine of this embodiment, the width W of the body 1 of the facsimile machine does not depend on the size of the paper feed cassette 7. This makes it possible to reduce the width W of the body 1 of the facsimile machine, and thus helps save the space occupied by the facsimile machine for a user who uses only letter-size sheets and A4-size sheets.

When legal-size sheets are used, as shown in FIG. 14, the tray 71 of the paper feed cassette 7 protrudes from the body 1 of the facsimile machine, forming a protrusion F. Here, the pickup roller 9 and the transfer rollers 10 are arranged in such a way that the protrusion F does not protrude farther than the original document stacker 4 or the recording paper stacker 12. This allows peripheral devices and the like to be placed in the space below the original document stacker 4 or the recording paper stacker 12.

Figure 16:
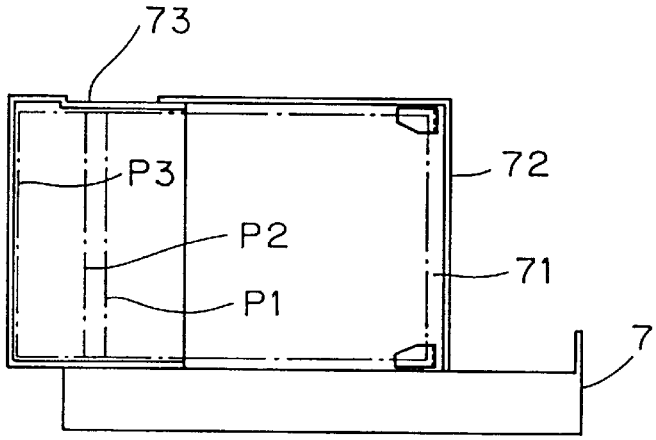
FIG. 16 is a diagram showing the paper feed cassette of the facsimile machine of the third embodiment.
Figure 17A:
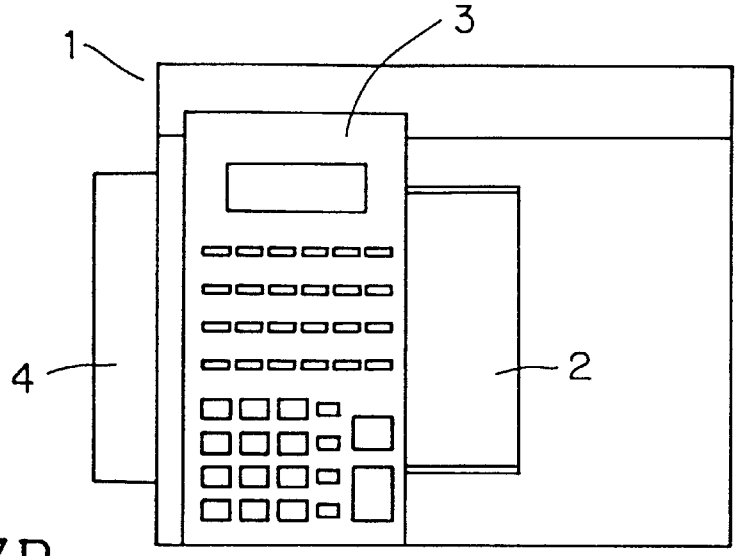
FIG.17A PRIOR ART
FIGS. 17A and 17B are diagrams showing an example of a conventional facsimile machine.
Figure 17B:
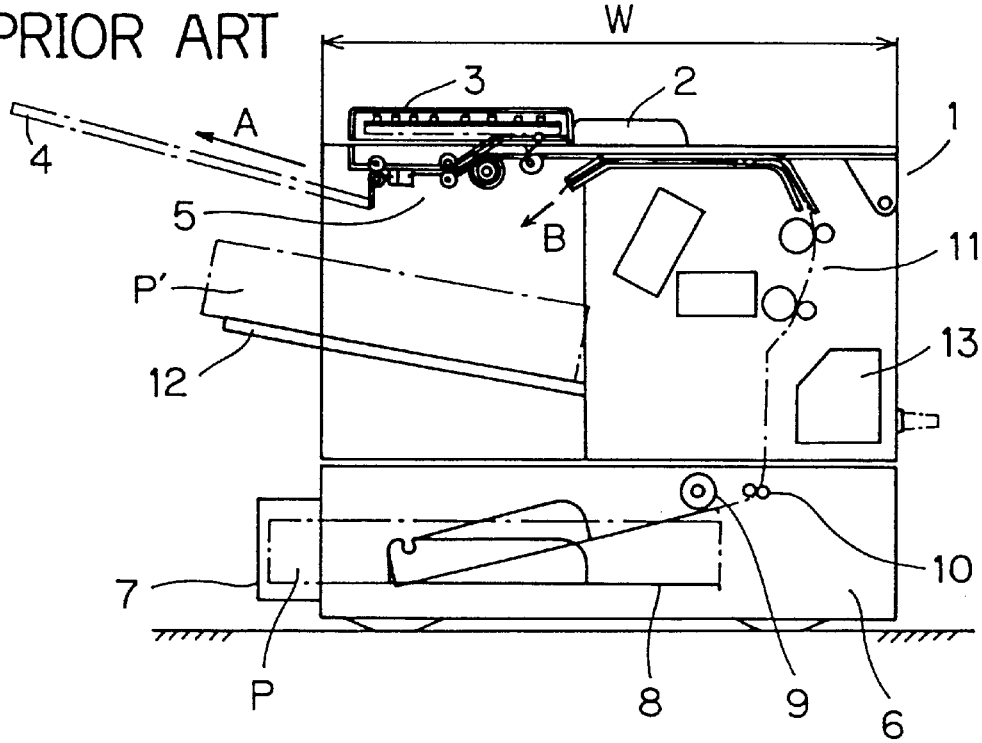
FIG.17B PRIOR ART
Figure 18A:
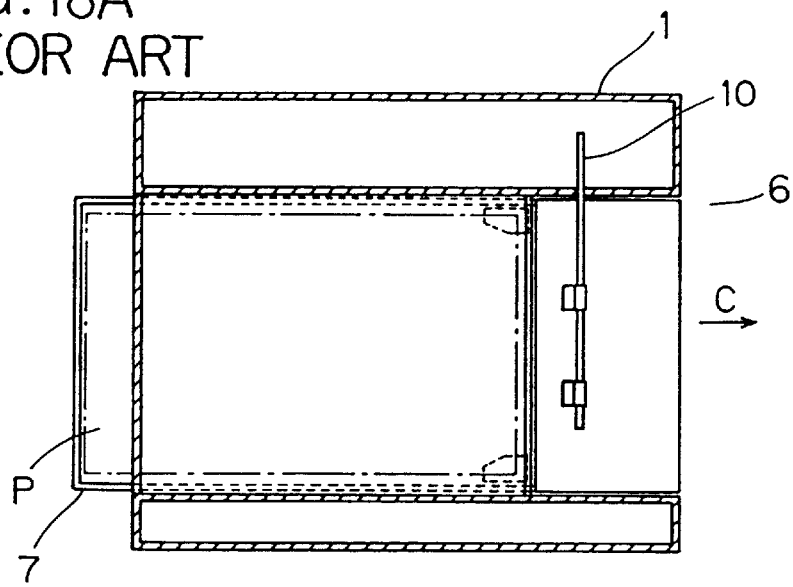
FIG.18A PRIOR ART
FIGS. 18A and 18B are diagrams showing the paper feeder section of the conventional facsimile machine shown in FIGS. 17A and 17B.
Figure 18B:
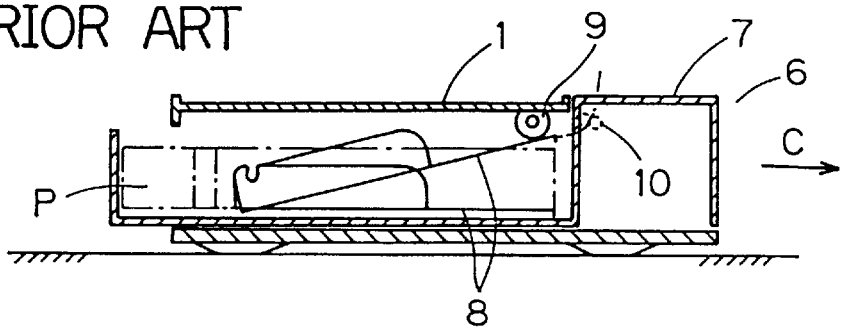
FIG.18B PRIOR ART
Figure 19:
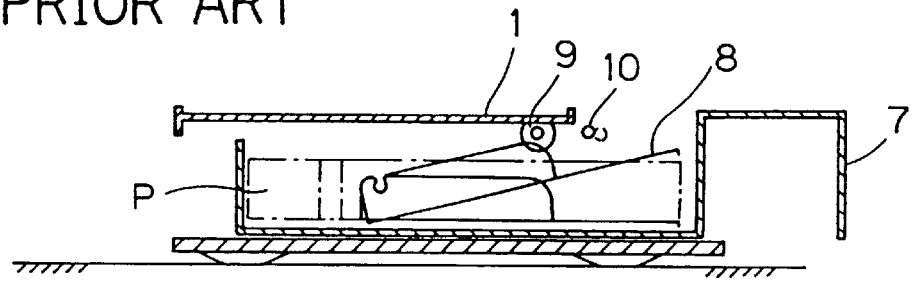
FIG.19 PRIOR ART
FIG. 19 is a diagram showing how the paper feed cassette is pulled out in the conventional facsimile machine shown in FIGS. 17A and 17B.
Figure 20A:
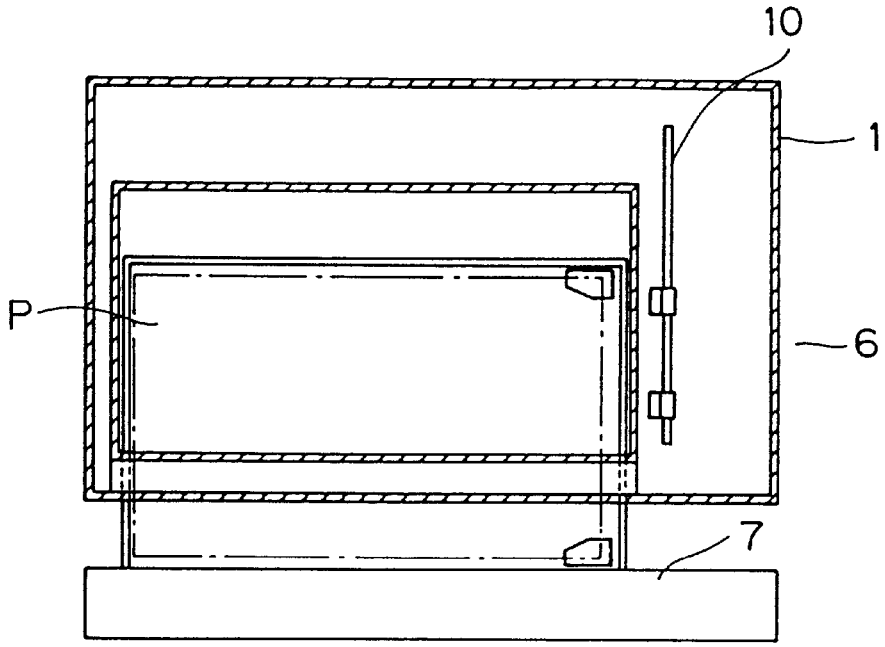
FIG.20A PRIOR ART
FIGS. 20A and 20B are diagrams showing the paper feeder section of another example of a conventional facsimile machine.
Figure 20B:
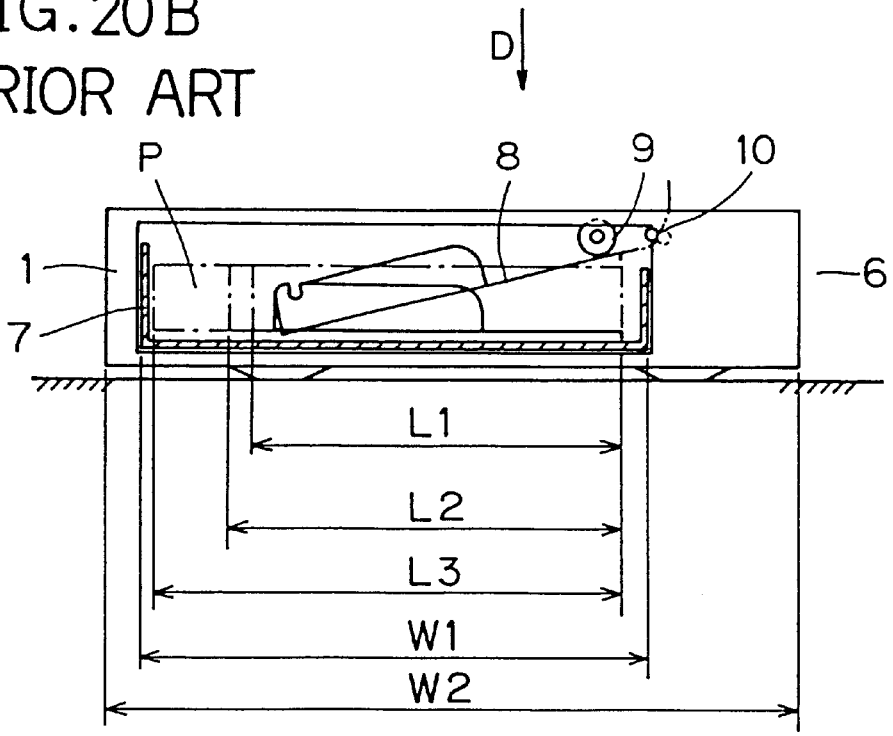
FIG.20B PRIOR ART
Figure 21B:
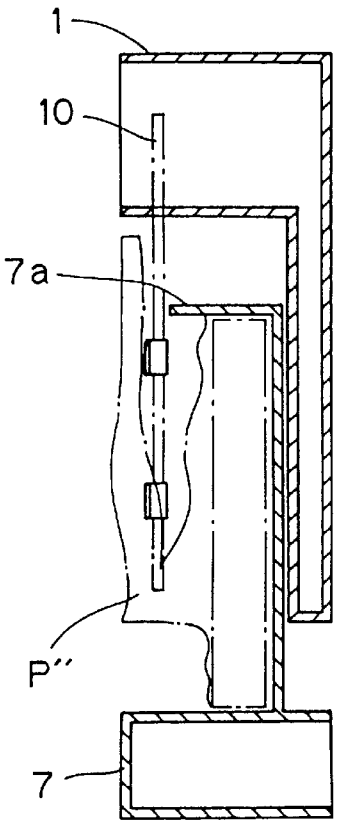
FIG.21B PRIOR ART
FIGS. 21A and 21B are diagrams illustrating the state of a paper jam as occurs in the conventional facsimile machine shown in FIGS. 20A and 20B.
Figure 21A:
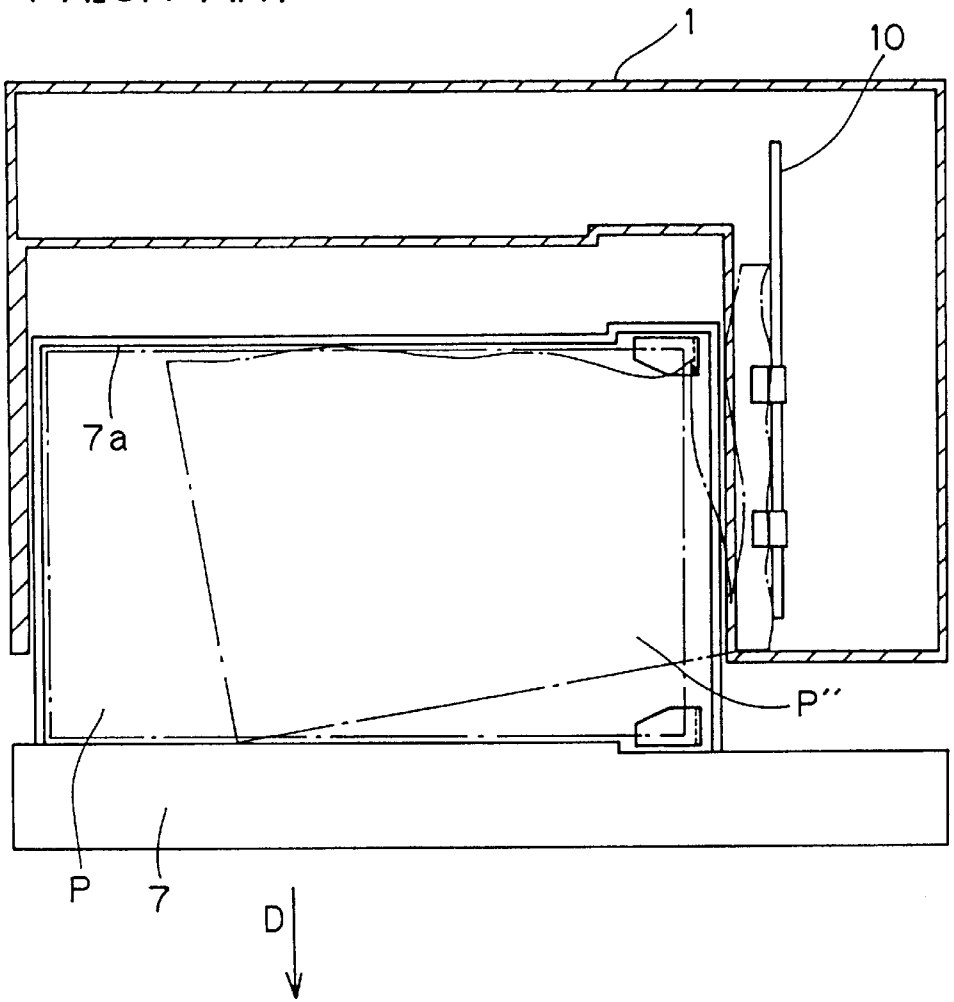
FIG.21A PRIOR ART

The frame 20 does not necessarily have to be provided; however, providing the frame 20 serves to compensate for the weakening of the mechanical strength at the open corner E (see FIG. 10B) of the C-shaped structure of the body 1 of the facsimile machine. Moreover, as shown in FIG. 16, the tray 71 is composed of a fixed portion 72 and a slidable portion 73. The slidable portion 73 is slidable so as to be expanded or contracted to different sizes corresponding to letter-size sheets P1, A4-size sheets P2, and legal-size sheets P3. This permits use of a single paper feed cassette 7 for various types of sheets of recording paper P. It is also possible to use a plurality of paper feed cassettes 7 each sized for a specific type of sheets of recording paper P.

The facsimile machine of this embodiment does not necessarily have to be designed to cope with letter-size, A4-size, and legal-size sheets as sheets of recording paper P as described above, but may be designed to cope with sheets of recording paper of other sizes. Moreover, although the first to third embodiments all deal with a facsimile machine, it is also possible to realize other kinds of image formation apparatuses, such as copiers and printers, employing a paper feed cassette on the basis of these embodiments. In a printer, where there is no need to place an original document, there is no need to provide an original document stacker 4. Therefore, in this case, it is preferable to arrange the paper feed cassette 7 in such a way that its protrusion F (see FIG. 14) does not protrude farther than the recording paper stacker 12.

What is claimed is:

1. An image formation apparatus in which a paper feed cassette loaded with sheets of recording paper is linearly mounted and in which the sheets of recording paper are fed to the image formation apparatus in a direction perpendicular to a direction in which the paper feed cassette is linearly mounted, wherein the image formation apparatus has an insertion cavity that is open, at one side, toward an insertion surface through which the paper feed cassette is inserted into the image formation apparatus and, at another side, toward a side surface that is perpendicular to said insertion surface, said insertion cavity making said insertion surface and said side surface each appear to be C-shaped, so that a cassette wider than the cavity can be inserted.

2. An image formation apparatus as claimed in claim 1, wherein the paper feed cassette is expandable according to a length of the sheets of recording paper.

3. An image formation apparatus as claimed in claim 1, wherein the image formation apparatus has a frame having an opening fitted to said insertion surface, said opening allowing passage therethrough of a paper feed cassette that can be loaded with sheets of recording paper having a maximum usable length, said frame being shiftable according to a size of the paper feed cassette.

4. An image formation apparatus as claimed in claim 1, wherein the image formation apparatus has a recording paper stacker for discharging and stocking the sheets of recording paper, said recording paper stacker being arranged so as to protrude farther than the paper feed cassette in a direction in which the sheets of recording paper are discharged.

5. An image formation apparatus as claimed in claim 1, wherein the image formation apparatus has a recording paper stacker for discharging and stocking the sheets of recording paper and an original document stacker for discharging and stocking an original document, said recording paper stacker or original document stacker being arranged so as to protrude farther than the paper feed cassette in a direction in which the sheets of recording paper are discharged.

* * * * *